US007999848B2

(12) United States Patent
Chew

(10) Patent No.: US 7,999,848 B2
(45) Date of Patent: Aug. 16, 2011

(54) METHOD AND SYSTEM FOR RAIL TRACK SCANNING AND FOREIGN OBJECT DETECTION

(75) Inventor: Khien Meow David Chew, Singapore (SG)

(73) Assignee: Stratech Systems Limited, The Strategy (SG)

( * ) Notice: Subject to any disclaimer, the term of this patent is extended or adjusted under 35 U.S.C. 154(b) by 1738 days.

(21) Appl. No.: 10/548,570

(22) PCT Filed: Jun. 11, 2005

(86) PCT No.: PCT/SG2005/000190

§ 371 (c)(1),
(2), (4) Date: Sep. 12, 2005

(87) PCT Pub. No.: WO2005/120924

PCT Pub. Date: Dec. 22, 2005

(65) Prior Publication Data

US 2006/0098843 A1 May 11, 2006

(30) Foreign Application Priority Data

Jun. 11, 2004 (SG) ..... 200403670-3

(51) Int. Cl.
*H04N 9/47* (2006.01)

(52) U.S. Cl. ..... 348/148; 348/159; 348/143; 348/153

(58) Field of Classification Search ..... 348/148, 348/159, 143, 153, 154; 340/435; 73/625
See application file for complete search history.

(56) References Cited

U.S. PATENT DOCUMENTS

| | | | | |
|---|---|---|---|---|
| 5,265,831 | A | 11/1993 | Muller | |
| 5,522,265 | A | 6/1996 | Jaeggi | |
| 5,627,508 | A | 5/1997 | Cooper et al. | |
| 5,787,369 | A | 7/1998 | Knaak | |
| 5,987,979 | A * | 11/1999 | Bryan | 73/146 |
| 6,215,519 | B1 * | 4/2001 | Nayar et al. | 348/159 |
| 6,417,765 | B1 * | 7/2002 | Capanna | 340/435 |
| 6,831,573 | B2 * | 12/2004 | Jones | 340/903 |
| 7,455,265 | B2 * | 11/2008 | Jones | 246/166 |

FOREIGN PATENT DOCUMENTS

| | | |
|---|---|---|
| GB | 2 372 315 | 8/2002 |
| JP | 07-010003 | 1/1995 |
| JP | 11-259775 | 9/1999 |
| WO | WO 02/055362 A1 | 7/2002 |

OTHER PUBLICATIONS

Derwent Abstract Accession No. 95-332242, JP 7228250 A (Teito Kosokudo Kotsu Eidan) Aug. 29, 1995.
Derwent Abstract Accession No. 01-313104, JP 2001078169 A (Mitsubishi Jukogyo KK) Mar. 23, 2001.
Derwent Abstract Accession No. 99-264864, DE 19746970 A1 (Alcatel) Apr. 29, 1999.

(Continued)

*Primary Examiner* — Houshang Safaipour
(74) *Attorney, Agent, or Firm* — Stephen A. Bent; Foley & Lardner LLP

(57) ABSTRACT

A method and system for detecting an object or abnormality on or near a rail track. The system comprises scanning means for scanning on and near a portion of the rail track; and detection means for determining the presence and location of the object or abnormality on or near the portion of the rail track based on information from the scanning means.

19 Claims, 5 Drawing Sheets

OTHER PUBLICATIONS

Derwent Abstract Accession No, 96-180792, DE 19536332 A1 (Aleksenko) Apr. 4, 1996.

Translation Japanese Office Action Application No. 2001-527150 dated Apr. 20, 2010.

Office Action Japanese Patent Application No. 2007-527150 dated Dec. 28, 2010 with translation.

Patent Abstracts of Japan Publication No. 07-120257 dated May 12, 1995.

Patent Abstracts of Japan Publication No. 08-180276 dated Jul. 12, 1996.

Patent Abstracts of Japan Publication No. 2004-042777 dated Feb. 12, 2004.

Patent Abstracts of Japan Publication No. 10-016777 dated Jan. 20, 1998.

Patent Abstracts of Japan Publication No. 59-156089 dated Sep. 5, 1984.

* cited by examiner

METHOD AND SYSTEM FOR RAIL TRACK SCANNING AND FOREIGN OBJECT DETECTION

FIELD OF THE INVENTION

The invention relates to method and system for detecting foreign objects or abnormalities on or near rail tracks.

BACKGROUND ART

Rail tracks are currently manually inspected i.e. either by involving people who have to walk along the rail track to visually identify a problem or by watching live or delayed video images from one or more cameras mounted on a platform that moves on the rail track. In the latter case, the inspection is based on visual inspection of "moving" video (or by examining many "still" small frames from the video) captured as the cameras move over the rails. Such methods and systems are not only slow and tedious, but also lower the chance and speed of detecting foreign objects or abnormalities around rail track due to human input required, and the associated risk of human error. Such methods are also resource intensive.

SUMMARY OF THE INVENTION

Embodiments of the invention can provide a system and method to detect foreign objects or abnormalities around rail tracks by capturing and processing images for obtaining relevant information.

Embodiments of the invention can provide advance warning of the presence of foreign objects (e.g., explosives or devices associated with explosive and bombs) or abnormalities on or in the vicinity of rail track (i.e., on or near the paths of trains), and allows for suitable action to be taken, hence aiding in the prevention of train and rail related accidents, whereby damages, destruction due to incidents, such as sabotage, ill intent and/or other natural or unnatural causes may be avoided.

In accordance with one aspect of the present invention, there is provided a system for detecting an object or abnormality on or near a rail track, the system comprising scanning means for scanning on and near a portion of the rail track; and detection means for determining the presence and location of the object or abnormality on or near the portion of the rail track based on information from the scanning means.

Preferably, the system further comprises camera means for capturing one or more images of the object or abnormality based on information from the detection means; and image processing means for processing the images captured by the camera means for deriving detection information.

According to another aspect of the present invention, there is provided a method of detecting an object or abnormality on or near a rail track, the method comprising scanning on and near a portion of the rail track utilising a scanning device; and determining the presence and location of the object or abnormality on or near the portion of the rail track based on information from the scanning means utilising a detection device coupled to the scanning device.

BRIEF DESCRIPTION OF THE DRAWINGS

The present invention is further described by way of non-limitative embodiments, with reference to the accompanying drawings, in which.

DETAILED DESCRIPTION

A system and method of automated rail track scanning, foreign object or abnormality detection along rail tracks are provided in example embodiments. The system processes captured images of areas around rail tracks ahead of a train to aid in the detection of the foreign objects or abnormalities. The system is mounted on an existing platform or stand alone unit that moves along the rail track. The movable vehicle includes normal or miniaturised rail vehicle hereinafter referred to as the scanning platform. At least one imaging device (e.g. a camera that can capture images) is used to capture a perspective and surrounding view of the track and at least one imaging device is used to capture a zoomed view of portions of the rail track. The system monitors the image streams obtained from the imaging devices to analyse and detect any foreign object or abnormalities and preferably to classify detected objects.

Figure 1:
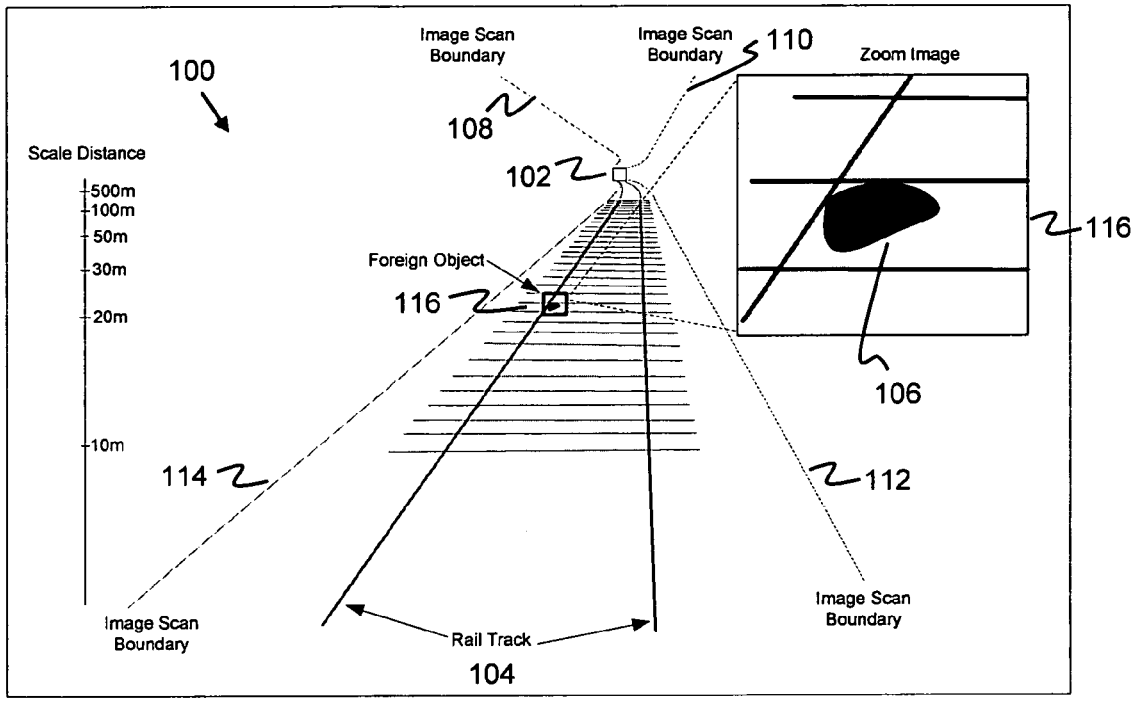
FIG. 1 is a schematic drawing illustrating a system and method to detect foreign objects or abnormality on rail track according to an example embodiment.

FIG. 1 shows a schematic drawing of a forward view 100 of a system to detect foreign objects using at least two video cameras mounted on a rail vehicle 102. One camera is used for "scanning" the rail track 104 for foreign objects 106 or abnormalities in a wide view image range (boundaries 108, 110, 112, and 114), whilst the other camera is used for zooming onto a detected foreign object 106 or a specific location on the rail track 104 or its surroundings (zoomed image 116). As an example, the wide view camera covers a track length of 500 meters ahead of the train. Once a potential foreign object is detected by the wide view camera, the zoom camera zooms to capture an image 116 around the detected foreign object 106 for analysis and classification.

Figure 2:
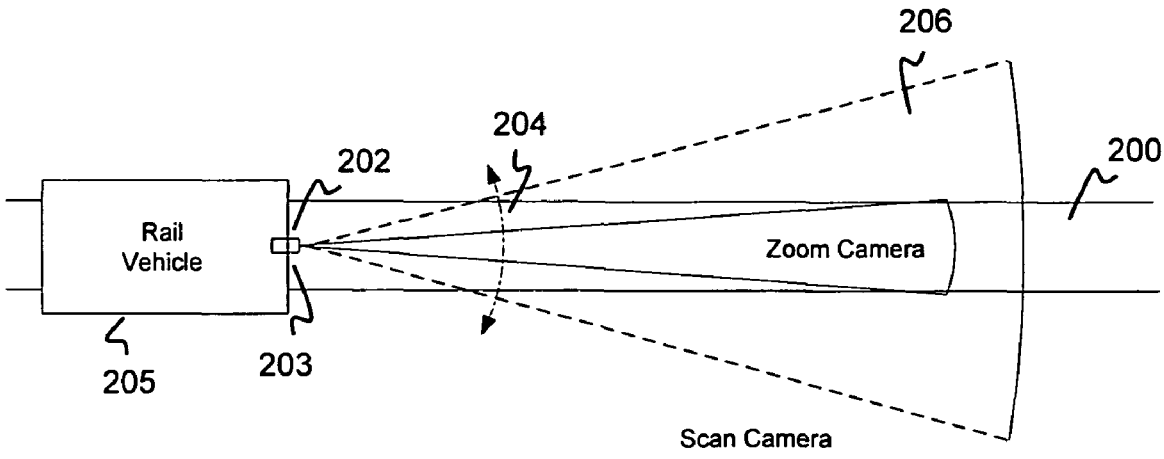
FIG. 2 is a schematic plan view drawing illustrating a system and method to detect foreign objects or abnormality on straight rail track according to an example embodiment.

FIG. 2 shows a schematic plan view illustrating a system and method to detect foreign objects or abnormalities around rail track 200 according to an example embodiment. A scan and a zoom camera are indicated at numerals 202, 203 respectively. It will be appreciated that the scan and zoom cameras may be implemented as one camera in example embodiments. The cameras 202, 203 are shown to be mounted on a rail-bound vehicle 205 moving on the straight rail track 200. The rail-bound vehicle may e.g. be a dedicated inspection vehicle, or a locomotive of other train engine or carriage. The scanning camera 202 is movable in a direction 204 and is able to scan an arc area 206 substantially including and surrounding the rail track 200 in the example embodiment. Similarly, the zooming camera 203 is movable to zoom onto objects or details within the arc 206.

Figure 3:
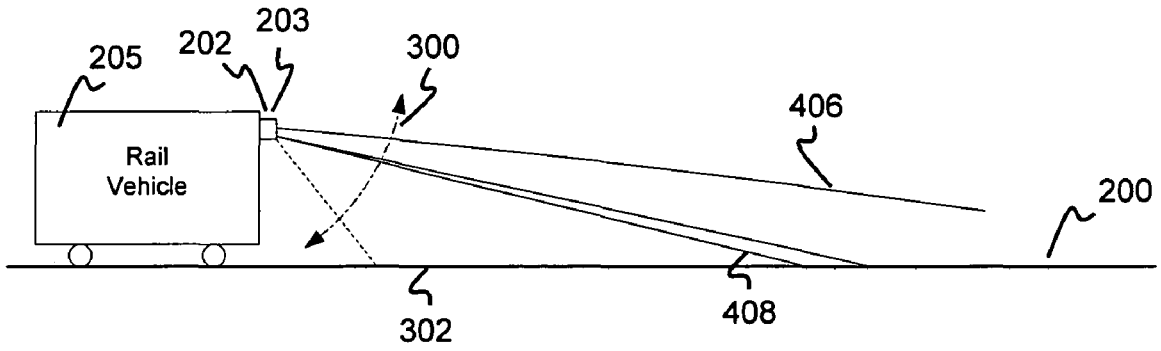
FIG. 3 is a schematic side view of FIG. 2.

FIG. 3 shows a schematic side view of the scene in FIG. 2 illustrating the system and method to detect foreign objects or abnormalities in the example embodiment. The scanning camera 202 is further movable in a direction of 300 and is able to scan an area substantially including and surrounding the 200 at different distances ahead of the vehicle 205. Similarly, the zooming camera 203 is movable to zoom onto objects or details within the overall scan region 302 of the scan camera 202.

Figure 4:
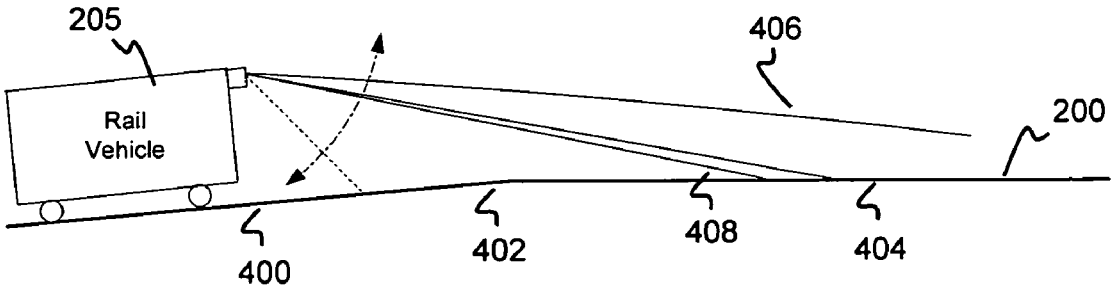
FIG. 4 is a schematic side view illustrating a system and method to detect foreign objects or abnormality on rail track when the train levels out from an upward inclination according to an example embodiment.

FIG. 4 shows a schematic side view illustrating the system and method to detect foreign objects in the example embodiment when the vehicle 205 levels out from an upward inclination, i.e. portion 400 of the track 200 is seen upward inclining up to a point 402, after which the track 200 levels to a horizontal portion 404.

Figure 5:
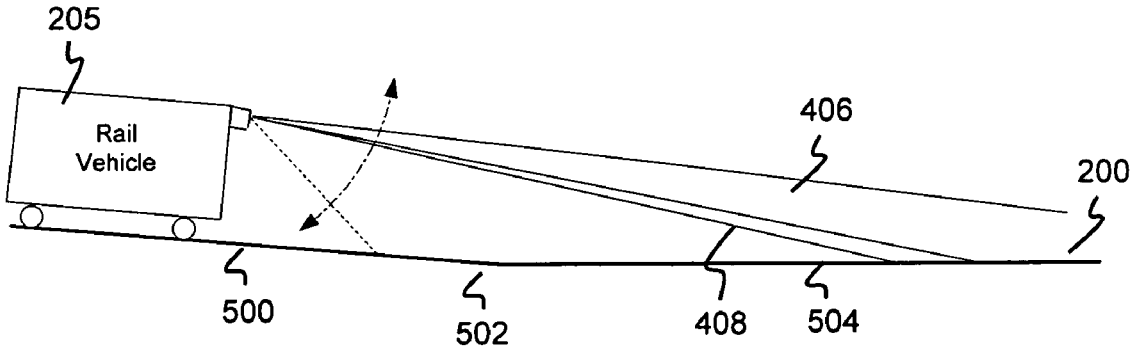
FIG. 5 is a schematic side view illustrating a system and method to detect foreign objects or abnormality on rail track when the train levels out from a downward inclination according to an example embodiment.

FIG. 5 shows a schematic side view illustrating the system and method to detect foreign objects and abnormalities in the example embodiment when the vehicle 205 levels out from a downward inclination, i.e. portion 500 of the track 200 is seen downwardly inclining up to a point 502, after which the track 200 levels to a horizontal portion 504.

Figure 6:
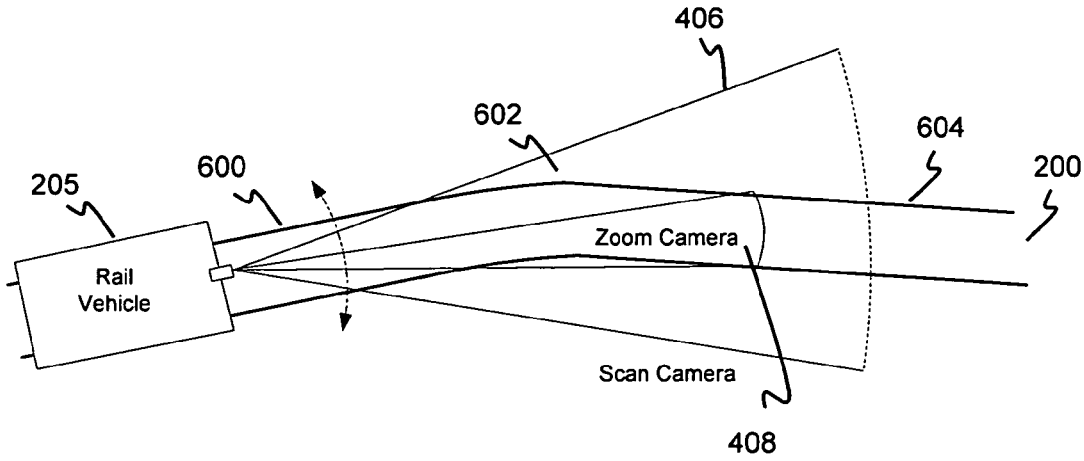
FIG. 6 is a schematic plan view of a system to detect foreign objects or abnormality on rail track when the train negotiates a curve on the railway track according to an example embodiment.

FIG. 6 shows a schematic plan view illustrating the system and method to detect foreign objects and abnormalities in the example embodiment when a vehicle 205 negotiates a curve along the direction of movement. That is, a portion 600 of the track 200 ahead of the vehicle 205 is shown to be curved around a point 502 in the horizontal direction of the track 200.

As illustrated in FIGS. 4 to 6, it will be appreciated that the system and method to detect foreign objects and abnormalities in the example embodiment is able to provide coverage of areas ahead substantially including and surrounding the rail track 200 under various track conditions such as inclines, declines, and curves. It will be appreciated that the coverage is provided for both the scanning camera (compare fields of view 406 in FIGS. 4 to 6), and for the zoom camera (compare example zoom fields 408 in FIGS. 4 to 6).

Figure 7:
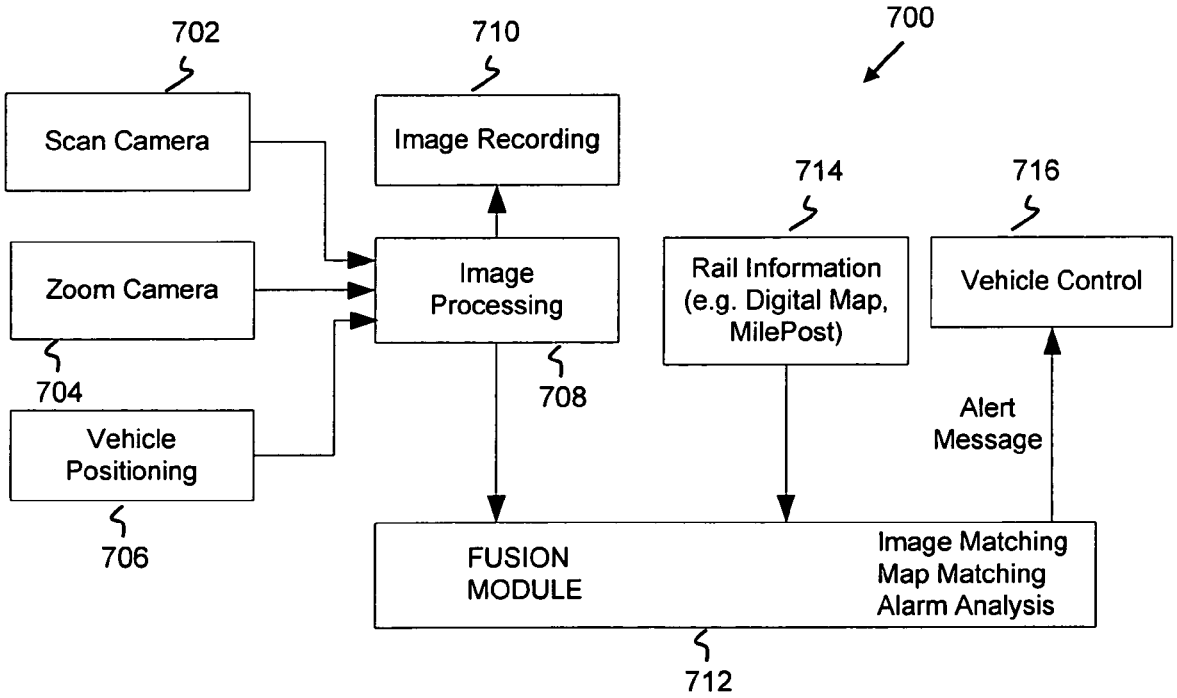
FIG. 7 is a functional block diagram showing the principal components of a system to detect foreign objects or abnormality on rail track according to an example embodiment.

FIG. 7 is a functional block diagram showing the principal coupled components of a system 700 to detect foreign objects according to an example embodiment. Information about images captured by the scan camera module 702 and zoom camera module 704 together with the information from vehicle positioning module 706 are continuously fed into an image processing module 708. The processed images are continuously recorded in image recording module 710. The processed images are also fed into a fusion module 712. Rail track information, such as a Digital Map, Geographic Information System and MilePost data, stored in a database 714 is also provided to and referred to by the fusion module 712. The fusion module 712 comprises algorithms for executing various functions such as image matching, map matching, feature matching, anomalies detection, foreign object detection and alarm analysis to identify discrepancies of the processed images and alerts a vehicle control module 716 for taking necessary precautionary measures.

Figure 8:
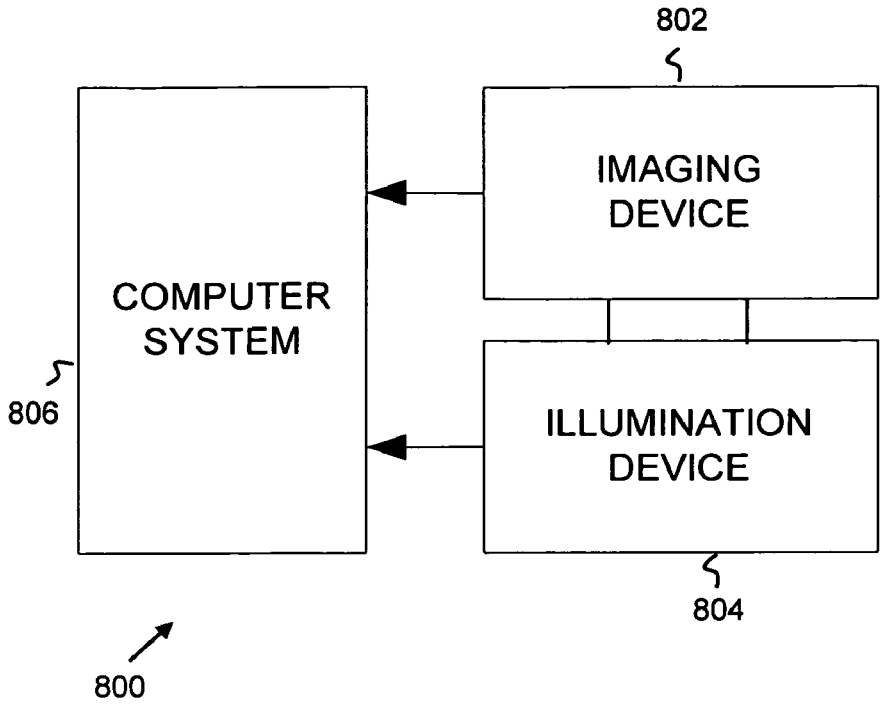
FIG. 8 is a block diagram illustrating various system devices for rail track scanning and foreign object or abnormality detection according to an example embodiment.

FIG. 8 is a basic block diagram illustrating various coupled devices for a rail track scanning and foreign object or abnormality detection system 800 in an example embodiment. An imaging device 802 and an illumination device 804 may be mounted on a platform at different locations. The images around rail tracks obtained from the imaging device 802 are fed to a computer system 806 for processing. The illumination device 804 in this embodiment enables use of the system 800 in limited light conditions, including at night time. It will be appreciated that the coverage of the illumination device 804 and the imaging device 802 are designed to match during operation. The imaging device includes scanning and zooming camera means (not shown) similar to those described with reference to FIGS. 1 to 6, which may e.g. be implemented as a single or separate cameras. The computer system 806 includes a core processing module (not shown), details of which will now be described with reference to FIG. 9.

Figure 9:
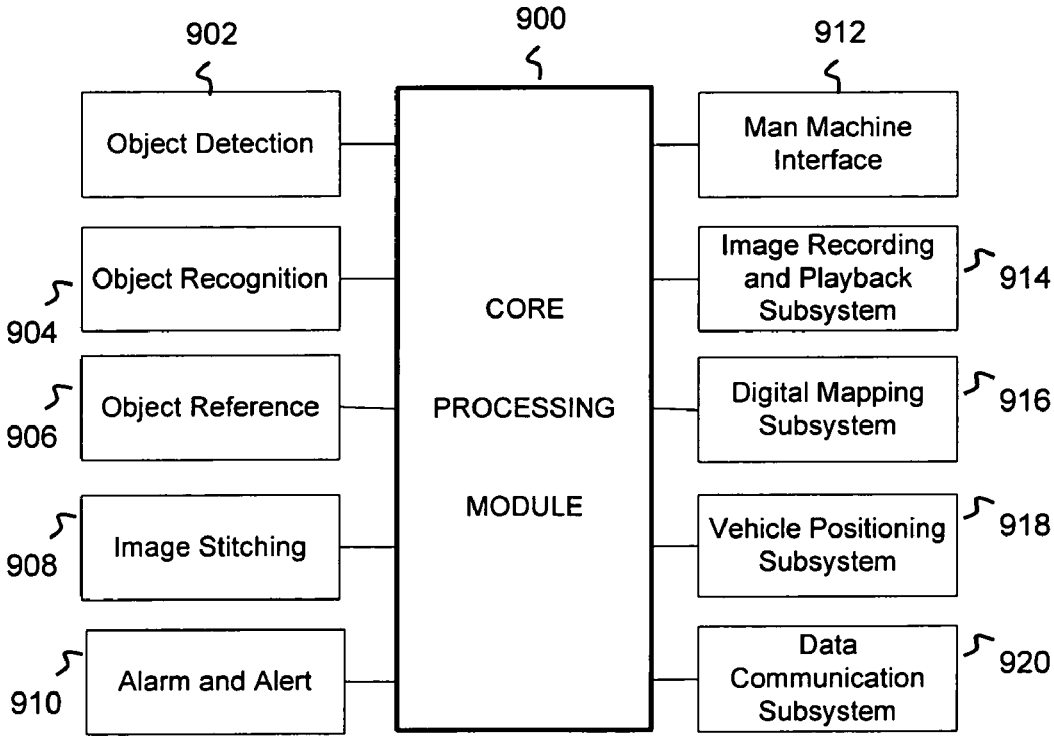
FIG. 9 is a functional block diagram of a processing system for rail track scanning and foreign object or abnormality detection according to an example embodiment.

FIG. 9 is a functional block diagram illustrating the core processing module 900 of a rail track scanning and foreign object or abnormality detection system in an example embodiment. The module 900 is coupled to a number of sub-systems e.g. 902. Upon detection of a foreign object by an object detection subsystem 902, the object recognition subsystem 904 classifies the detected object into normal or abnormal object by comparing the object with those stored in the object reference database subsystem 906. This helps in reducing false alarms. Object Recognition subsystem 904 can also classify objects into normal or abnormal object by using a set of rules or a rule based engine or an expert system. The image stitching subsystem 908 creates large and static images for better viewing to an operator. Once the object is classified as abnormal, the module 900 triggers the alarm and alert subsystem 910 whereby the operator is able to take necessary action through Man Machine Interface 912. The Image Recording and Playback subsystem 914 stores the processed images obtained from foreign object detection subsystem 902 for playback analysis. Further supporting subsystems, such as Digital Mapping subsystem 916, Geographic Information System, Vehicle Positioning subsystem 918 and Data Communication subsystem 918 provide the module 900 with the required information for better inspection result and control of the necessary devices.

In a preferred embodiment of an automated rail track scanning and foreign object or abnormality detection system, the area around the rail track is scanned and potential foreign objects or abnormalities on the rail track (and possibly their immediate surroundings on the ground including the sides of the track) are detected and the relevant people (and systems) are alerted regarding the presence, location and other relevant information about the potential foreign object(s) or abnormalities. The system in such an embodiment comprises:

i.) A computer system including an image processing module;

ii.) One or more imaging devices that are operable to scan the rail track from different views (i.e. front, rear, plan and side) and from different angles;

iii.) One or more second imaging devices with zooming capabilities to "lock onto" a detected foreign object or any selected locations on the track or its surroundings, especially for the front view and optionally for the side view. The first and second imaging devices may be implemented in single imaging devices;

iv.) A positioning subsystem (i.e. GPS, dead reckoning, beacons ) for providing positioning information;

v.) a digital mapping subsystem for displaying the captured information (i.e. image and detected foreign object location);

vi.) An image recording and playback subsystem;

vii.) A data communication subsystem for controlling and displaying images remotely;

viii.) A rail information database, including rail track Geographic Information System (GIS), which matches the image location to a digital map or milepost; and ix.) An alert management system that can inform rail track controllers in the event of foreign object detection.

Further embodiments may have one or more of:

x.) A database of objects and their profiles which are utilised by the system that determines the action to be taken when potential objects or abnormalities are detected, and to enhance object or abnormality detection, classification and/or identification capabilities;

xi.) A set of rules, a rule based engine or an expert system to be employed by the system that determines the action to be taken when potential objects or abnormalities are detected, and to enhance object or abnormality detection, classification and/or identification capabilities xii.) A controller or other decision-maker mounted remote to the scanning platform;

xiii.) Option for non-real-time processing and detection—e.g. for non-critical uses, such as periodic maintenance, etc;

xiv.) Imaging Stitching which provides the "static" view of scanned tracks; and xv.) An Illumination device, for instance attached near the imaging device.

As the platform carrying the devices moves, the scanning device captures images around the track. The scanning device can be mounted at an angle facing the track at the front, rear, side or mounted facing downwards towards the track. The images obtained are then stitched together to provide the operator with the manual option of going through scanned images of the rail track and to detect foreign objects and abnormalities.

The system may usually process every single frame captured from the one or more imaging devices, although this feature could be different or varied in other embodiments. The system may have two operation modes, i.e. training (or calibration) and actual operation. During the training mode, the boundary of an area of interest is defined (e.g. a sleeper region between the rails and a sleeper region outside the rails at defined distances). The system may utilise an initial calibration period for scene understanding and to differentiate normal background (common objects such as rails, sleepers, ballast, fasteners, bolts, nuts, etc.) images from foreign objects or abnormalities. During the actual operation, the system may compare key image parameters (describing common background track information) with the new acquired images, for foreign object and abnormalities detection. The key image parameters may be updated regularly to adapt to the background changes (e.g., weather, environment, illumination conditions). For sudden or even gradual background changes in the rail track section (e.g. a tunnel), the system may use stored image templates for comparison and foreign object detection. All the captured video images and detected foreign objects may be recorded and can be played back for manual inspection or to review the detected foreign object.

In an example embodiment, the system is able to discern foreign objects including dead leaves or litter. To reduce the possibility of a false alarm caused by normal foreign objects (e.g. dead leaves, litter, etc.), the sensitivity level of the system can be adjusted to ignore or discard such normal foreign objects. The normal foreign objects could also be filtered out based on visual attributes such as size, perimeter, area, profile, luminous intensity, colour etc. In other instances, the detection of foreign objects, such as dead leaves and litter may be important, e.g. when abnormal foreign objects may be hidden or covered by other, normal object (dead leaves, litter etc.). Certain configuration adjustments may be utilised to produce optimum results for different environments and purposes. It may be useful to combine cameras that pick up images in the visible and non-visible spectra. For example, the image from a normal camera may be used to discern leaves or litter whilst the images from an infra-red camera may be used to check if the leaves are emanating an unusual heat signature, indicating the presence of hidden objects.

FIGS. 1 to 7 show only forward looking object detection according to the example embodiments. However, it will be appreciated that the system may also have cameras pointing backwards (rear view), downwards, one or both sides of a platform. Further, the foreign object detection is not limited to detecting a physical object, but also includes detecting track bed surface disturbances, given that there is a possibility that a foreign object may be buried underneath the track.

In embodiments of the present invention, the system detects foreign objects or abnormalities by processing the image(s) of the track captured by the scanning device. Once the object or abnormality is detected by the scanning device, an optional imaging device can be used to zoom in and provide a higher resolution image of the object for improved classification and/or identification. At instances when a detected object is being assessed, the platform may stop temporarily. The relevant decision-maker, such as the backend controller or system operator is alerted to make a decision on the relevant action to take with respect to the detected object. The platform may continue to move and scan only after the decision-maker's permission is granted. The system allows the user to configure the region of interest by tilting the camera according to different device height of view and distance ahead.

Once the foreign object or abnormality is identified on the rail track, the system sends an alert signal to a system operator (who may also be the operator of an approaching train on or near the same track) and/or a backend controller for further action in an example embodiment. The system may also be integrated with positioning subsystem (i.e. GPS or dead reckoning) for determining the platform's position, possibly together with the GIS and digital map, so that the system can also determine, record, and report the locations of the images captured and foreign object(s) accurately and quickly. Other means of determining the location without using GPS or GIS map may be used .e.g. using radio or infrared beacons placed along the sides of the rail track. Using either pattern matching and image understanding algorithms or using a set of rules, a rule based engine or an expert system (that uses visual or non-visual information about normal rail track, abnormalities, or foreign objects), suspicious foreign objects can be detected and possibly classified and/or identified by comparing the captured track images with a database of foreign object images in real time. Captured images and processed images may be suitably indexed (with location information) so that the location of corresponding portions of the rail track can be determined or retrieved easily and quickly. Images or processed information regarding specific portions of the track and associated foreign objects can be stored and retrieved when necessary. Locations may be based on geographical map references or more conveniently based on specific markings on the track. In addition, the captured and processed images can be stored for play back purposes.

Apart from accurate detection of foreign objects, the system can have the ability to detect abnormalities or confirm the integrity of the rail track by examining the space between key structures and other objects that make up the rail track and its surroundings, including the side structures of the track, in an example embodiment. The scanning device can follow the rail track laid over varying terrains and curvatures. The scene and track information obtained by scanning device can be plotted onto a GIS and digital map to identify commonly known track features, such as switches, turns, and rail switching gear. Known track features may be enriched by the addition of new track data captured and processed by the system.

In order to facilitate that the scanning device correctly follows the rail track, the scanned images, as well as additional track and previously known track information, may be processed to determine the apparent movement of the rail track (as the scanning device moves over the rail track) which is then compensated by automatically adjusting the orientation of the scanning device or by other techniques (e.g., selection of scanning device to use if more than one imaging device is available).

The system can detect in real-time foreign objects along the rail in an example embodiment. The detection subsystem may include a feature extraction capability to determine whether or not a potential foreign object requires attention or whether it should be ignored. Using pattern recognition techniques, the visible features uniqueness (e.g. size, shape, luminous intensity and colour) from the detected foreign object may be compared with a known object database to determine the nature of the possible object. The object classification can also be achieved using a set of rules or a rule based engine or an expert system. Should a foreign object be detected, the system can be configured to alert the relevant decision-makers, such as the system operators or backend controllers for further action (e.g., to stop the scanning platform or approaching train).

The imaging device may be any optical or infrared camera of a desired frame rate and resolution. One or more scanning devices may be used. In some situations, e.g. for maintenance applications, the scanning device need not be installed at the front or be designed to capture track images ahead of the scanning platform (e.g., the scanning device could be capturing the parts of the track that are currently being passed over or have been passed over). The scanning device may also be installed at the rear of the platform, e.g. where the platform has the capability of travelling in the reverse direction. Video, still or visual imaging devices may be replaced or enhanced with other kinds of (scanning) sensor technologies that can provide structural information about the rail track, their immediate surroundings and objects on the rail track. The scanning platform need not be a rail vehicle travelling on the rail track e.g. it could be an unmanned aerial vehicle operated remotely.

At least one imaging device (hereafter referred to as the "scanning device") for rail track abnormality or foreign object detection system may be installed on a moving vehicle that scans the rail track or a train (referred to as the "scan platform") so that it scans the rail track ahead of the scan platform as the platform moves. The scan device itself may be installed remotely, rather than being installed in front, such as on the sides or the rear of the vehicle, for capturing the necessary images or videos of the relevant parts of the track to be captured.

An embodiment provides a method of rail track scanning and object presence or abnormality detection, and may also be able to provide larger and continuous stitched "still" images of the rail track, thereby facilitating image-based inspection and/or verification. The method may increase the level of accuracy and effectiveness compared to current methods.

Apart from detecting foreign objects, embodiments of the invention can also provide a method of viewing, or creating a record of the condition or state of the rail track in a manner which is easy to search and manage. Embodiments of the invention can also be used for maintaining rail track by spotting or predicting areas on the track where maintenance works or repairs may be needed. Embodiment may also be used for determining the condition of rail track before accidents/incidents and to determine the cause of the accidents/incidents. Embodiments may have application to inspection of other structures similar to rail tracks, such as long pipelines, building structures.

The invention claimed is:

1. A system for detecting an object or abnormality on or near a rail track, the system comprising:

scanning means for scanning on and near a portion of the rail track; and detection means for determining the presence and location of the object or abnormality on or near the portion of the rail track based on information from the scanning means, and one or more image devices for capturing continuous images of track with date/time stamp, latitude and longitude positioning, milestones, vehicle speed, and other parameters for easy retrieval and verification, the images being stitched together to enable a decision-maker to review images.

2. A system as claimed in claim 1, further comprising camera means for capturing one or more images of the object or abnormality based on information from the detection means; and image processing means for processing the images captured by the camera means for deriving detection information.

3. A system according to claim 2, wherein the detection information comprises a nature of the object or abnormality.

4. A system according to claim 2, further comprising checking means for checking the detection information derived against reference data in a database of the system.

5. A system according to claim 1, wherein the scanning means comprises one or more wide angle cameras and the detection means is operable to determine the presence and location of the object or abnormality based on image processing of images captured by the wide angle cameras.

6. A system according to claim 1, wherein the camera means comprises one or more zoom cameras.

7. A system according to claim 1, capable of automatic, real-time processing.

8. A system according to claim 1, comprising one or more of:

i.) a high resolution image of a captured object or abnormality;

ii.) object and/or abnormality position in a geographical co-ordinate system, e.g., latitude and longitude or distance along a track from known reference point;

iii.) object and/or abnormality distance from a scanning platform or some other known rail vehicle;

iv.) object and/or abnormality size, luminous intensity, color or dimensions, and/or other visual characteristics; and v.) possible object and/or abnormality classification or identification e.g., by matching information from object/rail database(s) or other sources or by using a set of rules or a rule based engine or an expert system.

9. A system according to claim 1, operable to compensate or adjust for one or more of varying terrain, curvature, environment, weather and switching track.

10. A system according to claim 1, operable to detect and locate a relevant track and associated structures for different viewing angles of an imaging device.

11. A system according to claim 1, operable to maintain and/or use a database of potential foreign objects and/or abnormalities, as well as objects and features that are expected to be found along a track.

12. A system according to claim 1, operable to classify a detected object as normal or abnormal based on a set of rules or a rule based engine or an expert system.

13. A system according to claim 1, operable to recognize a rail line for defining an image boundary and automatically adjust an area of interest and camera view as the rail track maneuvers around curved rail track.

14. A system according to claim 1, operable to adjust to gradual or even drastic background changes by continually updating background key image parameters.

15. A system according to claim 1, operable to adjust to sudden or gradual background changes by comparing a capture image with stored image templates.

16. A system according to claim 1, operable to detect hidden or covered physical foreign objects by analyzing track bed disturbances.

17. A method of detecting an object or abnormality on or near a rail track, the method, comprising:

scanning on and near a portion of the rail track utilizing a scanning device;

determining the presence and location of the object or abnormality on or near the portion of the rail track based on information from the scanning step utilizing a detection device coupled to the scanning device, and providing one or more image devices for capturing continuous images of track with date/time stamp, latitude and longitude positioning, milestones, vehicle speed, and other parameters for easy retrieval and verification, the images being stitched together to enable a decision-maker to review images.

18. A system for detecting an object or abnormality on or near a rail track, the system comprising:

scanning means for scanning on and near a portion of the rail track;

detection means for determining the presence and location of the object or abnormality on or near the portion of the rail track based on information from the scanning means, and one or more image devices for capturing continuous images of track with date/time stamp, latitude and longitude positioning, milestones, vehicle speed, and other parameters for easy retrieval and verification, the images being stitched together to enable a decision-maker to review images, wherein the system is operable to reduce false alarms due to normal foreign objects by making use of visual attributes of the object, wherein the visual attributes of the object comprise one or more of a group consisting of size, perimeter, area, profile, luminous intensity and color.

19. A method of detecting an object or abnormality on or near a rail track, the method comprising:

scanning on and near a portion of the rail track utilizing a scanning device;

determining the presence and location of the object or abnormality on or near the portion of the rail track based on information from the scanning step utilizing a detection device coupled to the scanning device, reducing false alarms due to normal foreign objects by making use of visual attributes of the object, and providing one or more image devices for capturing continuous images of track with date/time stamp, latitude and longitude positioning, milestones, vehicle speed, and other parameters for easy retrieval and verification, the images being stitched together to enable a decision-maker to review images, wherein the visual attributes of the object comprise one or more of a group consisting of size, perimeter, area, profile, luminous intensity, and color.

* * * * *